US008912894B2

(12) United States Patent
Carrieri

(10) Patent No.: US 8,912,894 B2
(45) Date of Patent: Dec. 16, 2014

(54) APPARATUS AND METHOD OF A COMBINED BURGLAR/FIRE ALARM HAVING ISOLATION

(76) Inventor: Michael Carrieri, Melville, NY (US)

( * ) Notice: Subject to any disclaimer, the term of this patent is extended or adjusted under 35 U.S.C. 154(b) by 589 days.

(21) Appl. No.: 13/222,674

(22) Filed: Aug. 31, 2011

(65) Prior Publication Data

US 2013/0049940 A1 Feb. 28, 2013

(51) Int. Cl.
*G08B 25/00* (2006.01)
*G08B 19/00* (2006.01)
*G08B 25/14* (2006.01)

(52) U.S. Cl.
CPC ..... *G08B 19/005* (2013.01); *G08B 25/14* (2013.01)
USPC ..... 340/288; 340/506; 340/3.1; 340/507; 340/511; 340/577

(58) Field of Classification Search
USPC ..... 340/506, 3.1, 507, 511, 577, 288; 326/30, 136
See application file for complete search history.

(56) References Cited

U.S. PATENT DOCUMENTS 4,118,019 A * 10/1978 Weir ..... 267/153
5,400,246 A * 3/1995 Wilson et al. ..... 700/17
6,011,465 A * 1/2000 Wang ..... 340/506

* cited by examiner

*Primary Examiner* — Daryl Pope
(74) *Attorney, Agent, or Firm* — Oakwood Law Group, LLP

(57) ABSTRACT

Apparatus located in a common box for providing a combination of fire and burglar alarm protection including a fire alarm control panel for providing fire alarm protection, a burglar alarm control panel which provides burglar alarm functionality mounted on the fire alarm control panel, a power supply coupled to the burglar bus to power only the burglary alarm control panel and burglar devices, a first switch located between the burglar alarm control panel and the fire alarm control to initiate operation of the burglar alarm system when closed; and a second switch located to provide power to all burglar alarm devices connected to the burglar module when closed. The first switch, when open, suspends only the operation of the burglar alarm control panel, and the second switch, when open, removes power from all burglar devices connected to the burglar module.

20 Claims, 1 Drawing Sheet

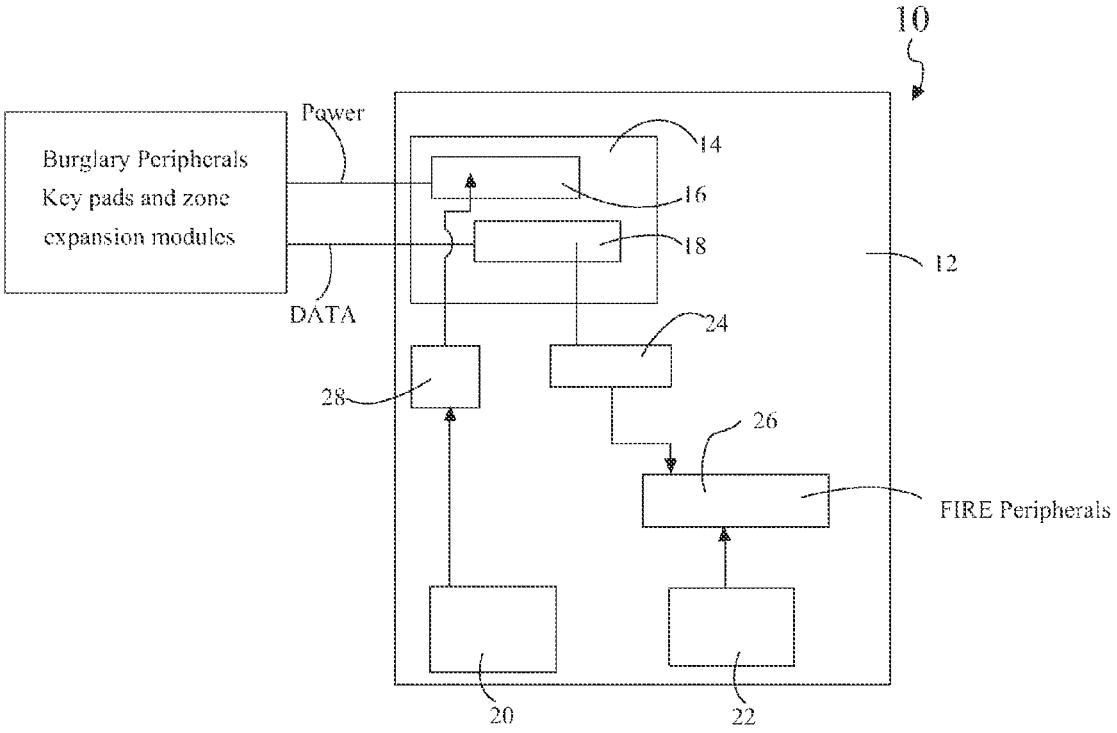
10
Power
Burglary Peripherals
Key pads and zone
expansion modules
DATA
14
16
18
12
24
28
26
FIRE Peripherals
20
22

APPARATUS AND METHOD OF A COMBINED BURGLAR/FIRE ALARM HAVING ISOLATION

BACKGROUND OF THE INVENTION

1. Field of the Invention

The present invention relates to a commercial burglar/fire apparatus and method located in a common box which address the various concerns of and is sanctioned and approved by Fire Marshals and Authorities Having Jurisdiction who must sanction and approve all commercial fire alarm system installations 2. Description of Related Art The security and fire alarm industry has seen a trend towards combination systems that provide fire and burglar alarm protection on one control panel. Some of the advantages of this technology are cost savings realized through the use of one control panel that performs the similar fire and burglar alarm processing, including zone input processing, alarm notification, local enunciation and central station reporting. Other advantages include reduced labor due the need to only install one control panel as well as the fact that many utility closets where the control panel is mounted will have space constraints, making it difficult to install separate fire and burglary alarm panels. Another benefit is the ability to both the fire and burglary events report the central station on one account number, which results in a cost savings to the alarm company.

However, there are drawbacks to the current technology combination systems, which impact their acceptance by Fire Marshals and Authorities Having Jurisdiction (AHJ), who must sanction and approve all commercial fire alarm system installations.

The Concerns of a Combined Burglar/Fire Device Include the Following:

The control panel power supply of a combination fire and burglary alarm system provides power to the fire alarm devices as well as the burglar alarm devices. If a problem occurs on the burglar alarm field power wiring, this will impact the fire alarm power, obstructing the operation of the fire alarm control panel.

Both the fire and burglar alarm system share the same backup battery power that is intended to provide operation of the fire system in the event of a power failure, typically for 24 hours. This is very difficult to achieve due to the fact that the burglar alarm portion of the system and its protective devices, such as keypads, motion detectors and glass break detectors draw considerably more current than the fire portion and devices. As a result, it is extremely difficult to achieve 24 hours of operation of both the burglar and fire alarm sections of the combinations alarm system during an AC power failure.

Most combination fire and burglar alarm systems use a common communication bus to communicate data to the fire alarm devices as well as the burglar alarm devices including keypads and zone expansion modules. If for any reason the burglary devices fail or are intentionally damaged, the communication bus may be compromised and the fire alarm functionality will be obstructed.

During service of the burglar alarm portion of the combination system, the fire alarm must be deactivated. This is due to the fact that both the fire and burglar functions of the control panel share common resources, making it impossible to service the burglar alarm devices, which share common communications and power with the fire devices.

SUMMARY OF THE INVENTION

In an exemplary embodiment of the present invention, there is disclosed apparatus located in a common box for providing a combination of fire and burglar alarm protection comprising:

a fire alarm control panel for providing fire alarm protection;

a burglar alarm control panel which provides burglar alarm functionality mounted on the fire alarm control panel;

a power supply coupled to the burglar bus to power only the burglary alarm control panel and burglar devices;

a first switch located between the burglar alarm control panel and the fire alarm control to initiate operation of the burglar alarm system when closed; and a second switch located to provide power to all burglar alarm devices connected to the burglar module when closed;

wherein the first switch, when open, suspends only the operation of the burglar alarm control panel;

wherein the second switch, when open, removes power from all burglar devices connected to the burglar module.

In another exemplary embodiment of the present invention, there is disclosed apparatus located in a common box for providing a combination of fire and burglar alarm protection comprising:

a burglar alarm control panel for providing burglar alarm protection;

a fire alarm control panel which provides fire alarm functionality which provides support for the burglar alarm control panel;

a power supply coupled to the fire control panel to power only the fire alarm control panel and fire devices;

a first switch located between the burglar alarm control panel and the fire alarm control to initiate operation of the burglar alarm system when closed; and a second switch located to provide power to all burglar alarm devices connected to the burglar module when closed;

wherein the first switch, when open, suspends only the operation of the burglar alarm control panel;

wherein the second switch, when open, removes power from all burglar devices connected to the burglar module.

In another exemplary embodiment of the present invention, there is disclosed a method for providing a combination of fire and burglar alarm protection comprises:

providing a fire alarm control panel for fire alarm protection;

mounting a burglar alarm control panel which provides burglar alarm functionality on the fire alarm control panel;

providing a power supply coupled to the burglar bus to power only the burglary alarm control panel and burglar devices;

locating a first switch between the burglar alarm control panel and the fire alarm control to initiate operation of the burglar alarm system when closed; and locating a second switch to provide power to all burglar alarm devices connected to the burglar module when closed;

wherein the first switch, when open, suspends only the operation of the burglar alarm control panel;

wherein the second switch, when open, removes power from all burglar devices connected to the burglar module.

The more important features of the invention have thus been outlined in order that the more detailed description that follows may be better understood and in order that the present contribution to the art may better be appreciated. Additional features of the invention will be described hereinafter and will form the subject matter of the claims that follow.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The foregoing has outlined, rather broadly, the preferred feature of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention and that such other structures do not depart from the spirit and scope of the invention in its broadest form.

BRIEF DESCRIPTION OF THE DRAWINGS

Other aspects, features, and advantages of the present invention will become more fully apparent from the following detailed description, the appended claim, and the accompanying drawings in which similar elements are given similar reference numerals.

FIG. 1 shows a block diagram of a combination burglar/fire apparatus that provides both the benefits of a combined burglar/fire device while at the same time addresses all of AHJ concerns in accordance with the principles of the invention.

DESCRIPTION OF THE PREFERRED EMBODIMENT

The burglar/fire alarm system here disclosed is a commercial fire/alarm system that also provides support for a completely isolated burglar alarm system. The system is configured to provide a burglar/fire combination system that offers the same isolation provided by physically separate devices.

A major concerns of Fire Marshals and Authorities Having Jurisdiction (AHJ) who must sanction and approve all commercial fire alarm system installations is that 1. A failure of a burglar alarm component or its associated wiring may effect the fire alarm operation.

In order to add burglar/alarm functionality to the system, an innovative new module was designed. This module incorporates a circuit design that physically separates all fire and burglar circuitry, ensuring that any failure related to the burglar alarm cannot impact the operation of the fire alarm.

In the system there is provided

A) Separation of power supplies:

The module design provides a dedicated power supply specifically designed to power the burglar bus and the burglar devices.

B) Separation of Outputs:

The module design provides a dedicated supervised output to drive the burglar/alarm sounding appliances.

C) Separation of Fire and Burglar Communication Buses:

The module design provides a separate dedicated conventional burglary bus that supports conventional burglary peripherals such as burglary keypads and zone expansion modules D) Separation of Standby Power:

The module design provides its own isolated burglary backup battery power and charging circuitry to allow the fire alarm to have its own dedicated backup battery supply. This allows the fire alarm panel to run on standby power during a power failure without the additional load of supporting all burglar alarm devices allowing much longer fire alarm standby times.

2) During service of the burglar alarm portion of the system, the fire alarm must be deactivated.

A) Traditionally, in order to service the burglar alarm, the complete system must be taken down rendering the fire alarm inoperable during the service call.

The system here disclosed eliminates this problem through a unique, UL approved feature. During a Burglar Alarm Service Mode, which is initiated at the onset of a service call, the removal of a PCB jumper suspends burglar alarm operation, allowing safe service of the burglar alarm.

Although the burglar alarm side is placed out of service, the fire alarm continues to operate normally, with no interruption in service.

When service is complete the jumper is replaced which reactivates the burglar alarm operation.

3) Combo systems have great difficulty providing sufficient backup standby power, since it must power both fire alarm and burglar alarm portions during an AC failure.

Separation of Standby Power

The module provides a dedicated power supply and charging circuit with standby battery power for the burglar alarm This allows the fire alarm portion to have its own dedicated battery supply permitting the fire alarm panel to run on standby power without the additional load of supporting and powering all burglary related functions and devices, allowing much longer fire alarm standby times.

Referring to FIG. 1, there is disclosed a block diagram of a commercial fire/burglar control panel 10 of a combination fire/burglar apparatus which provides both the benefits of a combined burglar/fire device, while at the same time addressing all of AHJ concerns.

The invention incorporates a fire alarm control panel that provides the burglar alarm functionality through the addition of a separate module (Burglar Module) that incorporates a unique circuit design that physically separates all fire and burglar circuitry, to ensure that any failure related to the burglar alarm cannot impact the operation of the fire alarm:

Separation of Power Supplies

The Burglar Module provides a dedicated independently regulated power supply specifically designed to provide power to the burglar protective devices and the burglary communication bus.

Separation of Fire and Burglary Com Busses

The burglar module provides a separate dedicated conventional burglar bus, supporting conventional burglar peripherals such as burglar keypads and zone expansion modules.

Separation of Standby Power

The burglar module provides its own isolated burglar backup battery power and charging circuitry 20 to allow the fire alarm portion to have its own dedicated backup battery supply This allows the fire alarm panel to run on its own dedicated standby battery power during an AC power failure without the additional load of supporting and powering all burglar related functions and devices allowing much longer fire alarm standby times.

Service Mode

The invention allows servicing of the burglar alarm portion of the system, while maintaining full fire protection. This feature, the burglar alarm service mode, is initiated by the system technician at the onset of the burglar alarm service call. Burglar alarm service mode is initiated by the activation of a switch, in the form of a circuit board jumper 24 which connects a terminal on the burglar communication bus 18 to a terminal on the fire control bus. The removal of this jumper suspends the burglar alarm operation of the system. The removal of a second jumper 28 removes power from all burglar alarm devices connected to the burglar module, allowing the burglar alarm section to be safely serviced. Although the burglar alarm side is placed out of service, the fire alarm continues to operate normally, with no interruption in service, providing continued protection to the building and occupants. When the technician is done, he/she replaces the jumpers, restoring burglar alarm functionality.

While there have been shown and described and pointed out the fundamental novel features of the invention as applied to the preferred embodiments, it will be understood that the foregoing is considered as illustrative only of the principles of the invention and not intended to be exhaustive or to limit the invention to the precise forms disclosed. Obvious modifications or variations are possible in light of the above teachings. The embodiments discussed were chosen and described to provide the best illustration of the principles of the invention and its practical application to enable one of ordinary skill in the art to utilize the invention in various embodiments and with various modifications as are suited to the particular use contemplated All such modifications and variations are within the scope of the invention as determined by the appended claims when interpreted in accordance with the breadth to which they are entitled.

What is claimed is:

1. Apparatus located in a common box for providing a combination of fire and burglar alarm protection comprising:

a fire alarm control panel for providing fire alarm protection;

a burglar alarm control panel which provides burglar alarm functionality mounted on the fire alarm control panel;

a power supply coupled to a burglar bus to power only the burglary alarm control panel and a plurality of burglar devices;

a first switch located between the burglar alarm control panel and the fire alarm control panel to initiate operation of a burglar alarm system when closed; and a second switch located to provide power to all the burglar devices connected to a burglar module when closed;

wherein the first switch, when open, suspends only the operation of the burglar alarm control panel;

wherein the second switch, when open, removes power from all the burglar devices connected to the burglar module.

2. The apparatus of claim 1 wherein the burglar alarm control panel independently supports the burglar alarm functionality without compromising integrity of the fire alarm protection.

3. The apparatus of claim 1, wherein the power supply coupled to the burglar control panel is an independently regulated backup battery power supply.

4. The apparatus of claim 1, wherein the burglar devices are conventional burglar peripherals which include burglar keypads or zone expansion modules.

5. The apparatus of claim 3, wherein the independently regulated battery power supply is coupled to its own burglar backup battery power and charging circuitry, allowing the fire alarm control panel to have its own dedicated backup battery supply.

6. The apparatus of claim 1, wherein when the first switch is open, service of the burglar alarm system may be performed with uninterrupted fire alarm protection.

7. The apparatus of claim 1 wherein the first and second switches are jumper cables.

8. Apparatus located in a common box for providing a combination of fire and burglar alarm protection comprising:

a burglar alarm control panel for providing burglar alarm protection;

a fire alarm control panel which provides fire alarm functionality which provides support for the burglar alarm control panel;

a power supply coupled to the fire control panel to power only the fire alarm control panel and fire devices;

a first switch located between the burglar alarm control panel and the fire alarm control panel to initiate operation of a burglar alarm system when closed; and a second switch located to provide power to all burglar alarm devices connected to the burglar module when closed;

wherein the first switch, when open, suspends only the operation of the burglar alarm control panel;

wherein the second switch, when open, removes power from all burglar devices connected to the burglar module.

9. The apparatus of claim 8 wherein the fire alarm control panel independently supports fire alarm functions without compromising integrity of the burglar alarm protection.

10. The apparatus of claim 8, wherein the power supply coupled to the fire control panel is an independently regulated backup battery power supply.

11. The apparatus of claim 8, wherein the fire devices are conventional fire peripherals which includes smoke detectors or heat detectors.

12. The apparatus of claim 10, wherein the independently regulated battery power supply is coupled to its own fire backup battery power and charging circuitry, allowing the burglar alarm control panel to have its own dedicated backup battery supply.

13. The apparatus of claim 8, wherein when the first switch is open, service of the burglar alarm portion of the system may be performed with uninterrupted fire alarm protection.

14. The apparatus of claim 8 wherein the first and second switches are jumper cables.

15. A method for providing a combination of fire and burglar alarm protection comprises:

providing a fire alarm control panel for fire alarm protection;

mounting a burglar alarm control panel which provides burglar alarm functionality on the fire alarm control panel;

providing a power supply coupled to a burglar bus to power only the burglary alarm control panel and burglar devices;

locating a first switch between the burglar alarm control panel and the fire alarm control panel to initiate operation of a burglar alarm system when closed; and locating a second switch to provide power to all burglar alarm devices connected to a burglar module when closed;

wherein the first switch, when open, suspends only the operation of the burglar alarm control panel;

wherein the second switch, when open, removes power from all burglar devices connected to the burglar module.

16. The method of claim 15 wherein the burglar alarm control panel independently supports burglar alarm functions without compromising integrity of the fire alarm protection.

17. The method of claim 15, wherein the power supply coupled to the burglar control panel is an independently regulated backup battery power supply.

18. The method of claim 15, wherein the burglar devices are conventional burglar peripherals which includes burglar keypads or zone expansion modules.

19. The method of claim 17, wherein the independently regulated battery power supply is coupled to its own burglar backup battery power and charging circuitry, allowing the fire alarm control panel to have its own dedicated backup battery supply.

20. The method of claim 15, wherein when the first switch is open, service of the burglar alarm portion of the system may be performed with uninterrupted fire alarm protection.

* * * * *